US010952487B2

(12) United States Patent
Atkins

(10) Patent No.: US 10,952,487 B2
(45) Date of Patent: Mar. 23, 2021

(54) BEVERAGE DISPENSING UMBRELLA HEADWEAR

(71) Applicant: Ty Atkins, Jacksonville, FL (US)

(72) Inventor: Ty Atkins, Jacksonville, FL (US)

( * ) Notice: Subject to any disclaimer, the term of this patent is extended or adjusted under 35 U.S.C. 154(b) by 30 days.

(21) Appl. No.: 16/142,261

(22) Filed: Sep. 26, 2018

(65) Prior Publication Data

US 2019/0090572 A1 Mar. 28, 2019

Related U.S. Application Data

(63) Continuation-in-part of application No. 29/637,681, filed on Feb. 21, 2018, now Pat. No. Des. 892,442.

(60) Provisional application No. 62/563,087, filed on Sep. 26, 2017.

(51) Int. Cl.

| | |
|---|---|
| ***A42B 1/24*** | (2006.01) |
| ***A42B 3/04*** | (2006.01) |
| ***A45B 11/02*** | (2006.01) |
| ***A45B 11/04*** | (2006.01) |
| ***A42B 1/18*** | (2006.01) |
| ***A45F 3/16*** | (2006.01) |

(52) U.S. Cl.

CPC ..... *A42B 3/048* (2013.01); *A42B 1/18* (2013.01); *A42B 1/24* (2013.01); *A42B 3/0406* (2013.01); *A45B 11/02* (2013.01); *A45B 11/04* (2013.01); *A45F 3/16* (2013.01)

(58) Field of Classification Search

CPC .. A42B 3/048; A42B 1/24; A42B 1/00; A42B 1/18; A45B 2023/0006; A45B 11/02

USPC ..... 2/209.13

See application file for complete search history.

(56) References Cited

U.S. PATENT DOCUMENTS

| | | | | |
|---|---|---|---|---|
| 4,326,301 | A * | 4/1982 | Brock | A45B 11/04 135/16 |
| 4,681,244 | A | 7/1987 | Geddie | |
| 4,739,905 | A * | 4/1988 | Nelson | A42B 3/048 2/422 |
| 4,760,610 | A | 8/1988 | Wu et al. | |
| 5,966,743 | A | 10/1999 | Flann | |
| 9,179,724 | B1 | 11/2015 | Schultz et al. | |

* cited by examiner

*Primary Examiner* — Timothy K Trieu

(74) *Attorney, Agent, or Firm* — Boudwin Intellectual Property; Daniel Boudwin

(57) ABSTRACT

A beverage dispensing headwear having an umbrella affixed thereto. A pair of container holders is affixed on opposing sides of a helmet. A three-way valve is fastened to the helmet, wherein a first and second intake tube are fluidly connected to the three-way valve on a proximal end and are configured to be inserted into a container held within one of the container holders on a distal end. An output tube is also fluidly connected to the three-way valve on a proximal end of the output tube. The output tube extends below the rim of the helmet at a distal end, wherein the distal end of the output tube is configured to be sucked on by a user. Additionally, an umbrella is affixed to the helmet.

7 Claims, 4 Drawing Sheets

BEVERAGE DISPENSING UMBRELLA HEADWEAR

CROSS REFERENCE TO RELATED APPLICATIONS

This application claims the benefit of U.S. Provisional Application No. 62/563,087 filed on Sep. 26, 2017 and U.S. Design patent application Ser. No. 29/637,681 filed on Feb. 21, 2018. The above identified patent application is herein incorporated by reference in its entirety to provide continuity of disclosure.

BACKGROUND OF THE INVENTION

The present invention relates to beverage dispensing headwear. Specifically the present invention relates to beverage dispensing headwear having a sun shading means affixed thereto.

People tailgating sporting events or otherwise spending leisure time outdoors need to accomplish two priorities: hydration and protection from the sun. Often times at tailgating events, hydration comes in the form of an alcoholic beverage. Traditional means for obtaining these priorities typically required a person to hold a parasol in one hand while holding a cold beverage in the other, thus tying up both hands from any other task such as playing games or cooking. Therefore, a handsfree combination beverage holder and umbrella cap is needed.

Several devices are known which aide in solving this problem. One such device includes a helmet having a plurality of container holders thereon, wherein a tube runs from each container and into a mouthpiece. This device also provides restrictive valves on tubes running to alcohol, allowing a user to mix drinks by simply sipping on the mouthpiece. However, this device fails to provide a user with protection from the sun with an umbrella disposed on the helmet.

SUMMARY OF THE INVENTION

In view of the foregoing disadvantages inherent in the known types of beverage dispensing headwear now present in the known art, the present invention provides a beverage dispensing umbrella headwear wherein the same can be utilized for providing convenience for the user when taking shelter from the sun. The present beverage dispensing umbrella headwear comprises a pair of container holders affixed to a helmet, wherein the container holders are disposed on opposite sides of the helmet. A three-way valve is affixed to the helmet. A first and second intake tube are fluidly connected to the three-way valve on one end of each tube and, on a second end of each tube, the tubes fluidly communicate with a container sequestered within each container holder. A flow restrictor is disposed in the first intake tube. An output tube is affixed to the three-way valve on one end and is configured to be suctioned by a user's mouth on an opposite end. An umbrella is affixed to the top of the helmet.

One object of the present invention is to provide a beverage dispensing umbrella headwear which allows a user to mix a non-alcoholic beverage with an alcohol, wherein both the alcohol and non-alcoholic beverages are contained within containers sequestered within a pair of container holders affixed to a helmet.

Another object of the present invention is to provide a beverage dispensing umbrella headwear having an umbrella affixed to a helmet.

Yet another object of the present invention is to provide a beverage dispensing umbrella headwear having an alcohol intake tube and a non-alcoholic intake tube, wherein a flow restrictor reduces the flow of liquid out of the first intake tube 25 percent relative to the flow of liquid from the second intake tube.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
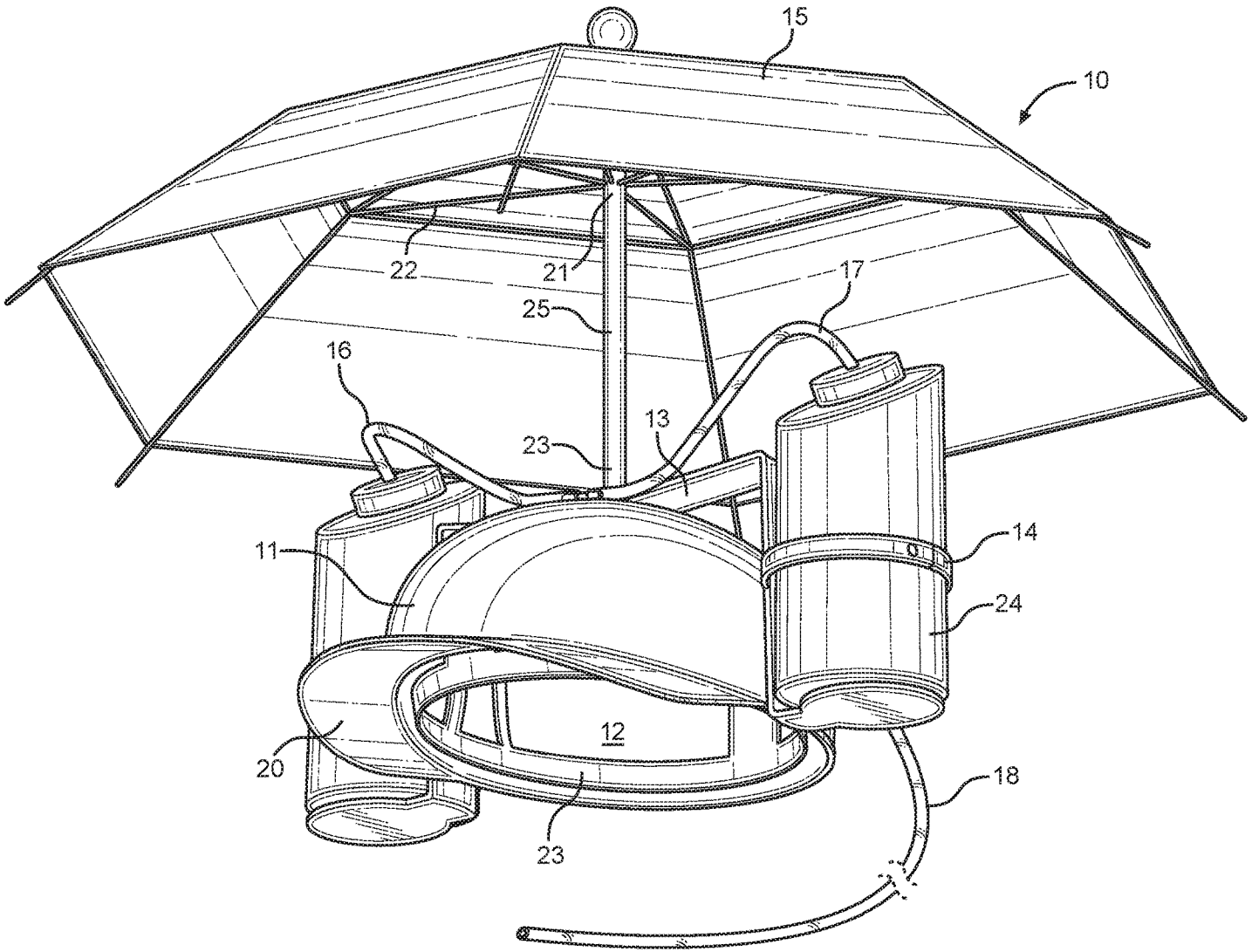
FIG. 1A shows a perspective view of an embodiment of the beverage dispensing umbrella headwear.

Reference is made herein to the attached drawings. Like reference numerals are used throughout the drawings to depict like or similar elements of the beverage dispensing umbrella headwear. The figures are intended for representative purposes only and should not be considered to be limiting in any respect. Unless specifically limited to a single unit, "a" is intended to be equivalent to "one or more" throughout the present disclosure.

Figure 1B:
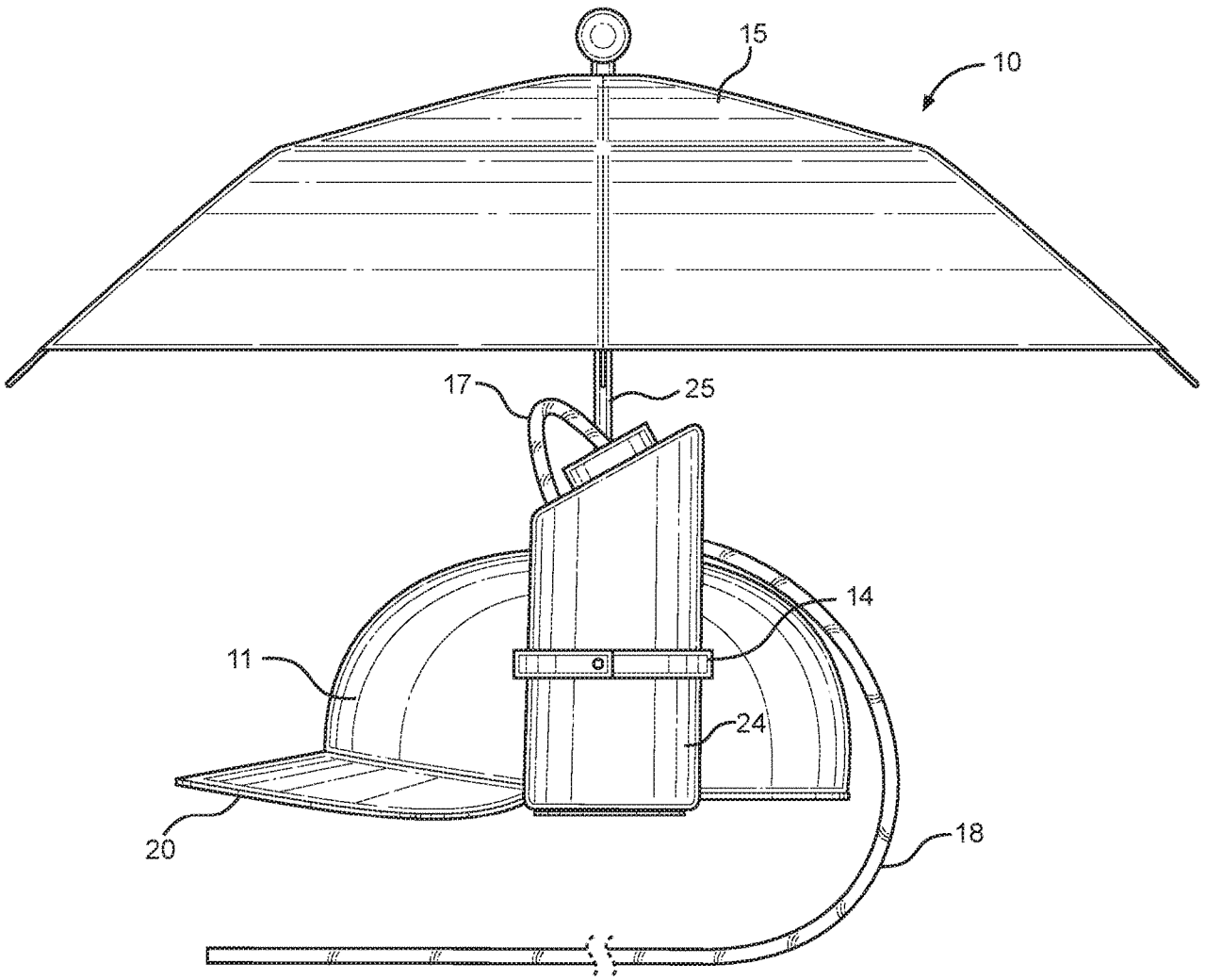
FIG. 1B shows a side view of an embodiment of the beverage dispensing umbrella headwear.

Referring now to FIGS. 1A and 1B, there is shown a perspective view and a side view of an embodiment of the beverage dispensing umbrella headwear. The beverage dispensing umbrella headwear 10 comprises a helmet 11 having a pair of container holders 14 affixed thereto. In the illustrated embodiment, the helmet 11 resembles a hardhat having a bill 20 and a headband 23 affixed to an interior surface 12 of the helmet 11, wherein the headband 23 frictionally secures the helmet 11 to the head of a user.

An umbrella 15 having a shaft 16 is affixed to the helmet 11. The shaft has a top end 21 and a bottom end 23, wherein the bottom end 23 is affixed to the helmet 11. The shaft 16 extends directly upwards from a crown of the helmet. The umbrella 15 is supported in a deployed position, as shown in FIG. 1, by a plurality of ribs 22 that extend radially outward from the shaft 16, wherein the ribs 22 extend radially outward from the top end 21 of the shaft 16. In certain embodiments, the umbrella 15 is retractable.

The container holders 14 are disposed on opposite sides of the helmet 11 so that when the helmet 11 is dawned by a user the container holders 14 are located on a left side and a right side of the helmet 11. The container holders 14 are configured to secure a container 24 therein, wherein the containers 24 may hold a liquor, other alcoholic beverage or a non-alcoholic beverage. A user can drink the contents of the containers 24 through a series of tubes that fluidly connect the interior of the containers 24 to a mouth of a user. The series of tubes comprises a first intake tube 17, a second intake tube 16 and an output tube 18.

In the illustrated embodiment, a crossbar 13 is secured to the helmet, wherein the crossbar 13 connects to and extends between each container holder 14. The crossbar 13 is secured to the helmet 11 on the crown of the helmet 11. In some embodiments, the shaft 16 of the umbrella 15 is staked through the crossbar 13, thereby securing the crossbar 13 to the crown of the helmet 11.

Figure 2:
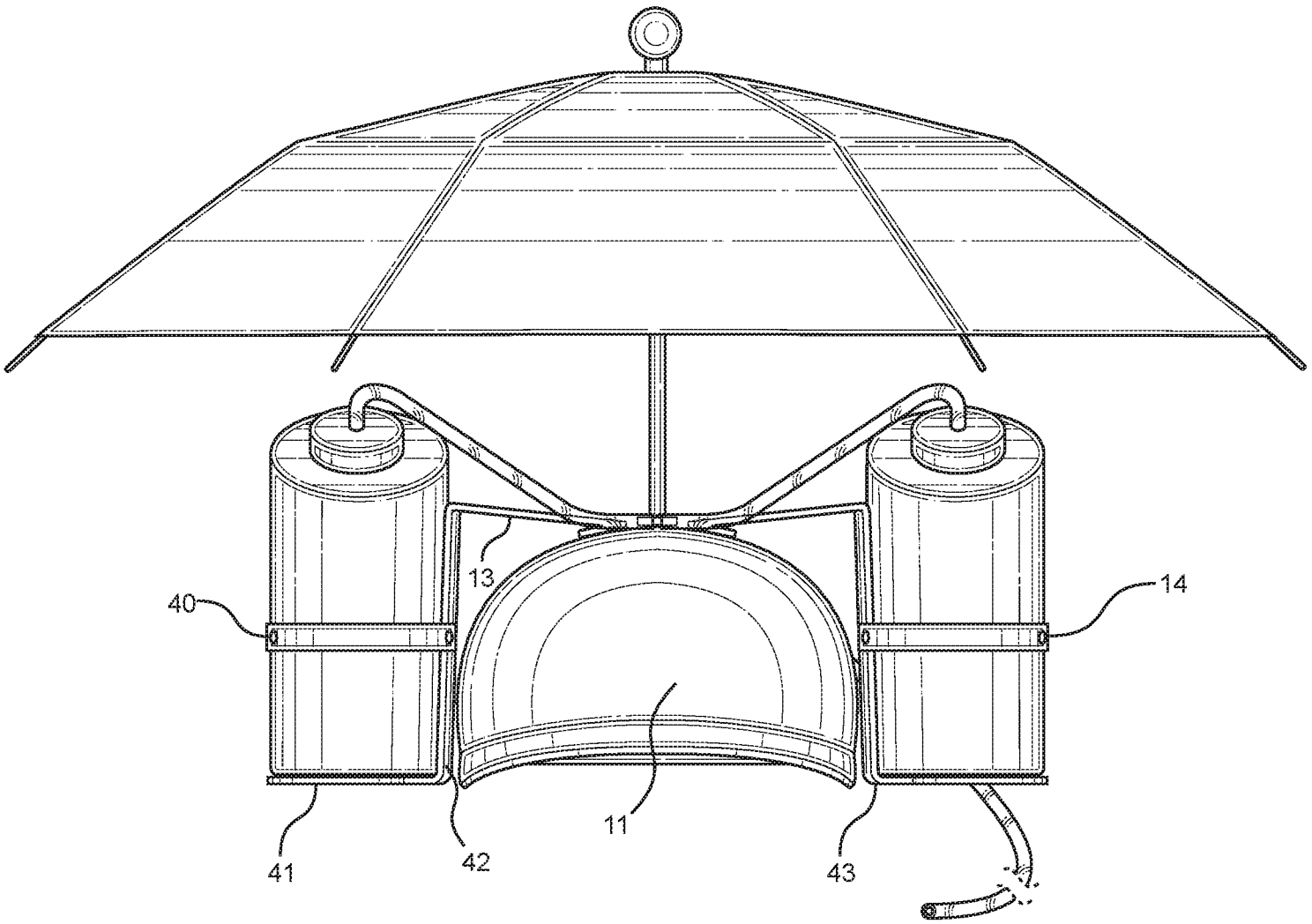
FIG. 2 shows a side elevation view of an embodiment of the beverage dispensing umbrella headwear.

Now referring to FIG. 2, there is shown a side elevation view of an embodiment of the beverage dispensing umbrella headwear. In the shown embodiment, each container holder 14 further comprises an elongated longitudinal support member 42 extending perpendicularly downward from the crossbar 13. A base member 41, which in the present embodiment is circular, is perpendicularly disposed at a terminal end 43 of the elongated longitudinal support member 42. The base member 41 protrudes outward from the helmet 11. Additionally, a ring member 40 is affixed to the elongated longitudinal support member 42. The ring member 40 also protrudes perpendicular outward from the elongated longitudinal support member 42. The ring member 40 is disposed between the base member 41 and the crossbar 13. In the illustrated embodiment, the crossbar 13, elongated longitudinal support member 42 and base member 41 are a monolithic construction.

Figure 3:
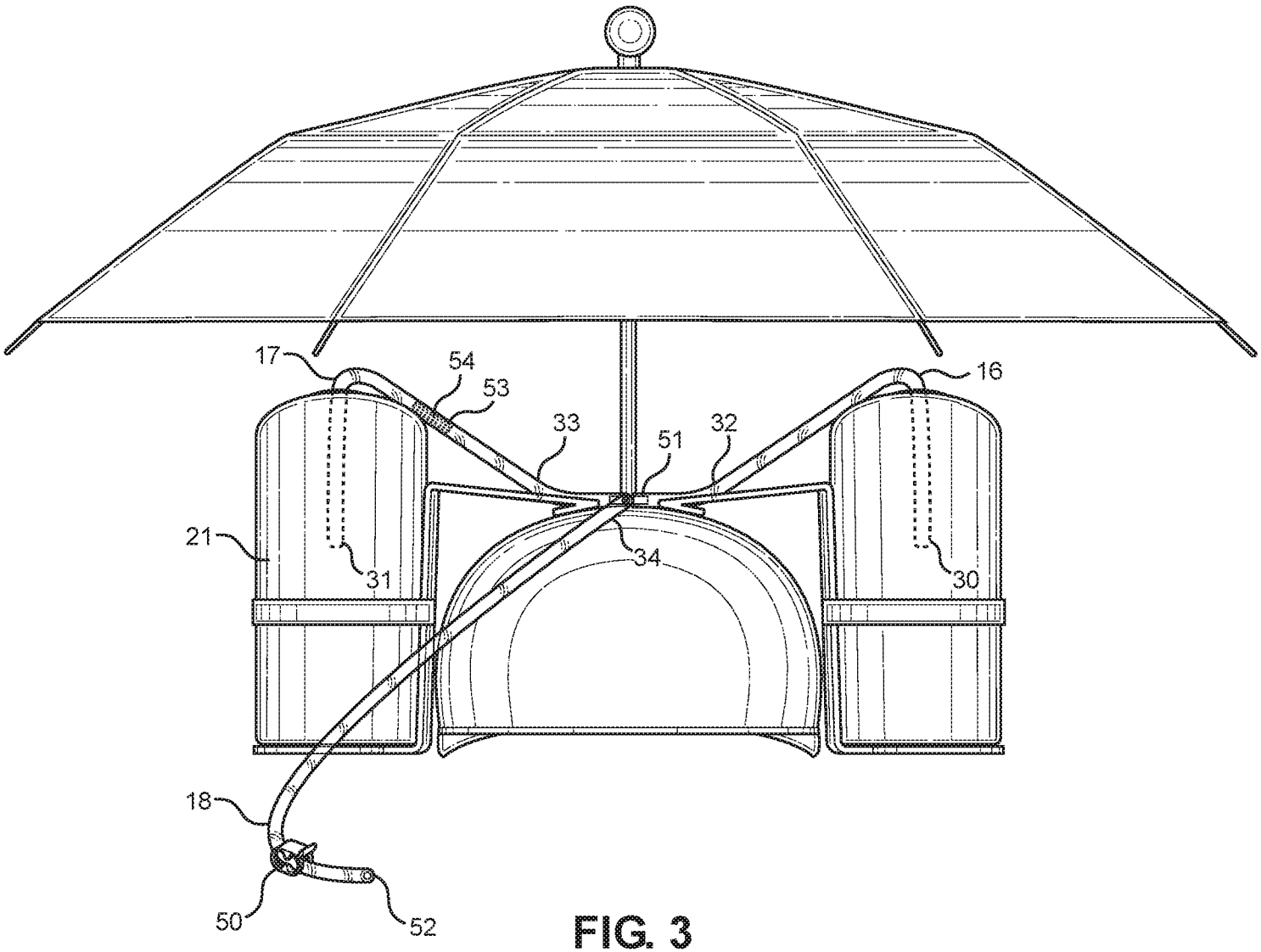
FIG. 3 shows an elevation view from the back side of an embodiment of the beverage dispensing umbrella headwear.

Now referring to FIG. 3, there is shown an elevation view from the back side of an embodiment of the beverage dispensing umbrella headwear. To enable a user to extract the contents in the containers 24 the first intake tube 17, the second intake tube 16 and the output tube 18 are fastened to a three-way valve 51 at a proximal end 32, 33, 34 of each of the tubes 17, 16, 18, wherein each of the tubes 16, 17, 18 are in fluid communication with the three-way valve 51. The three-way valve 51 thereby fluidly connects the first 17 and second 16 intake tubes to the output tube 18. A distal end 30 of the first intake tube 17 is disposed in one container 24 and a distal end 31 of the second intake tube 16 is disposed within the other container 24.

A distal end 52 of the output tube 18 functions as a mouth piece, wherein a user can apply a suctional force to the contents of the containers by sipping on the distal end 52 of the output tube 18. In the shown embodiment, the first intake tube 17, the second intake tube 15 and the output tube 18 all have an equivalent diameter. The first intake tube 17 is inserted into the container 24 having liquor therein. To reduce the flow of liquor through the first intake 17 tube relative to the flow of a non-alcoholic liquid through the second intake tube 16, a flow restrictor 53 is disposed within the first intake tube 17. In the present embodiment, the flow restrictor 53 reduces the flow through the first intake tube 17 by 25 percent relative to the flow through the second intake tube 16.

In one embodiment, the flow restrictor 53 is a cylindrical member having a channel 54 therethrough, wherein the diameter of the channel 54 is smaller than the diameter of the first tube 17. In this way, as equivalent forces will be applied to both the first 17 and second 16 intake tubes via a user applying a sectional force to the output tube 18. In other embodiments the flow restrictor 53 is a flow control valve, wherein the flow control valve is a coupling between the proximal end 32 of the first intake tube 17 and the three-way valve 51.

In some embodiments, a stopper 50 is disposed along the output tube 18 and configured to prevent any liquid from traveling from either the first or second intake tubes 16, 17 beyond the position of the stopper 50. In the illustrated embodiment, the stopper 50 comprises opposing teeth that are designed to pinch the output tube 18 such that the output tube 18 is flat at a single point such that the interior of the output tube 18 is closed.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A beverage dispensing umbrella headwear, comprising:

a helmet;

a pair of container holders affixed to the helmet, wherein each container holder is disposed on an opposing side of the helmet;

a three-way valve fastened to the helmet;

a first intake tube and a second intake tube, wherein a proximal end of the first intake tube and a proximal end of the second intake tube are secured to the three-way valve and each of a distal end of the first intake tube and a distal end of the second intake tube are configured to be inserted into a container removably disposed in each of the pair of the container holders;

wherein each of the first intake tube and the second intake tube are in fluid communication with the three-way valve and a container disposed in each of the pair of the container holders;

a flow restrictor disposed within the first intake tube;

an output tube secured to the three-way valve at a proximal end of the output tube, wherein the output tube is in fluid communication with the three-way valve, wherein a distal end of the output tube is configured to be engaged by the mouth of a user so as to apply a suctional force to the output tube;

a crossbar secured to a crown of the helmet, wherein the crossbar connects to and extends between each container holder of the pair of container holders;

an umbrella having a shaft affixed to the crossbar, wherein the shaft extends upward from the helmet.

2. The beverage dispensing umbrella headwear of claim 1, wherein the helmet has a bill.

3. The beverage dispensing umbrella headwear of claim 1, wherein the flow restrictor restricts a flow of liquid from the first intake tube 25 percent relative to the flow of liquid from the second intake tube.

4. The beverage dispensing umbrella headwear of claim 1, wherein the umbrella is configured to selectively move between an open position, wherein the umbrella radiates outward from the shaft, and a closed position, wherein the umbrella is folded against the shaft.

5. The beverage dispensing umbrella headwear of claim 1, wherein each container holder of the pair of container holders further comprises an elongated longitudinal support member, a base and a ring member, wherein the elongated longitudinal support member extends perpendicularly downward from the crossbar, wherein the base is affixed to a terminal end of an elongated longitudinal support member and the ring member is affixed to the elongated longitudinal support member between the base member and the crossbar.

6. The beverage dispensing umbrella headwear of claim 1, further comprising a stopper disposed along the output tube, configured to prevent liquid from flowing through the distal end thereof.

7. A beverage dispensing umbrella headwear, comprising:

a helmet;

a pair of container holders affixed to the helmet, wherein each container holder is disposed on an opposing side of the helmet;

a three-way valve fastened to the helmet;

a first intake tube and a second intake tube, wherein a proximal end of the first intake tube and a proximal end of the second intake tube are secured to the three-way valve and each of a distal end of the first intake tube and a distal end of the second intake tube are configured to be inserted into a container disposed in each of the pair of the container holders;

wherein each of the first intake tube and the second intake tube are in fluid communication with the three-way valve and a container disposed in each of the pair of the container holders;

a flow restrictor disposed entirely within the first intake tube;

an output tube secured to the three-way valve at a proximal end of the output tube, wherein the output tube is in fluid communication with the three-way valve, wherein a distal end of the output tube is configured to be engaged by the mouth of a user so as to apply a suctional force to the output tube;

a crossbar secured to a crown of the helmet, wherein the crossbar connects to and extends between each container holder of the pair of container holders;

an umbrella having a shaft affixed to the crossbar, wherein the shaft extends upward from the helmet.

* * * * *